US008385577B2

(12) United States Patent
Fickweiler et al.

(10) Patent No.: US 8,385,577 B2
(45) Date of Patent: Feb. 26, 2013

(54) FIXING A SOUND TUBE IN A HEARING APPARATUS

(75) Inventors: Werner Fickweiler, Bubenreuth (DE); Robert Kasanmascheff, Höchstadt (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1328 days.

(21) Appl. No.: 11/786,793

(22) Filed: Apr. 12, 2007

(65) Prior Publication Data

US 2008/0037812 A1 Feb. 14, 2008

(30) Foreign Application Priority Data

Apr. 19, 2006 (DE) ..... 10 2006 018 156

(51) Int. Cl.
*H04R 25/00* (2006.01)

(52) U.S. Cl. ..... 381/382; 381/328; 381/329; 381/338

(58) Field of Classification Search ..... 381/330, 381/338, 382, 328, 329; 181/130, 135, 18–22
See application file for complete search history.

(56) References Cited

U.S. PATENT DOCUMENTS

| | | | | |
|---|---|---|---|---|
| 2,545,731 | A * | 3/1951 | French | 181/135 |
| 2,849,533 | A * | 8/1958 | Di Mattia | 381/382 |
| 2,934,160 | A * | 4/1960 | Touson | 181/130 |
| 3,440,314 | A * | 4/1969 | Frisch | 264/222 |
| 3,736,929 | A | 6/1973 | Mills | |
| 3,783,864 | A * | 1/1974 | Moller | 128/864 |
| 4,006,796 | A * | 2/1977 | Coehorst | 181/130 |
| 4,724,922 | A * | 2/1988 | Kalayjian | 181/135 |
| 4,852,683 | A * | 8/1989 | Killion | 181/130 |
| 5,002,151 | A * | 3/1991 | Oliveira et al. | 181/130 |
| 5,031,219 | A * | 7/1991 | Ward et al. | 381/328 |
| 5,046,580 | A * | 9/1991 | Barton | 181/135 |
| 7,600,604 | B2 * | 10/2009 | Babcock et al. | 181/130 |
| 8,160,288 | B2 * | 4/2012 | Axelsson | 381/380 |
| 2005/0031146 | A1 * | 2/2005 | Baskerville | 381/328 |
| 2005/0190939 | A1 * | 9/2005 | Fretz | 381/330 |

FOREIGN PATENT DOCUMENTS

| | | |
|---|---|---|
| DE | 94 06 801 U1 | 7/1994 |
| DE | 195 23 991 B4 | 4/2004 |
| DE | 20 2005 004 245 U1 | 9/2005 |
| GB | 1462899 | 1/1977 |

* cited by examiner

*Primary Examiner* — Curtis Kuntz
*Assistant Examiner* — Ryan Robinson

(57) ABSTRACT

A thin hearing tube is to be fastened in a hearing apparatus such that it can be easily exchanged again. To this end, the end of the sound tube is melted, so that its diameter is enlarged. The sound tube can then be drawn into the bore, the inner diameter of which is smaller than the enlarged outer diameter of the end of the sound tube, until the extended end of the sound tube rests closely against one side of the bore. By cutting the sound tube end or by cutting through the tube at another point, it can be removed from the bore without any problem, so that a new tube can be fastened there.

9 Claims, 1 Drawing Sheet

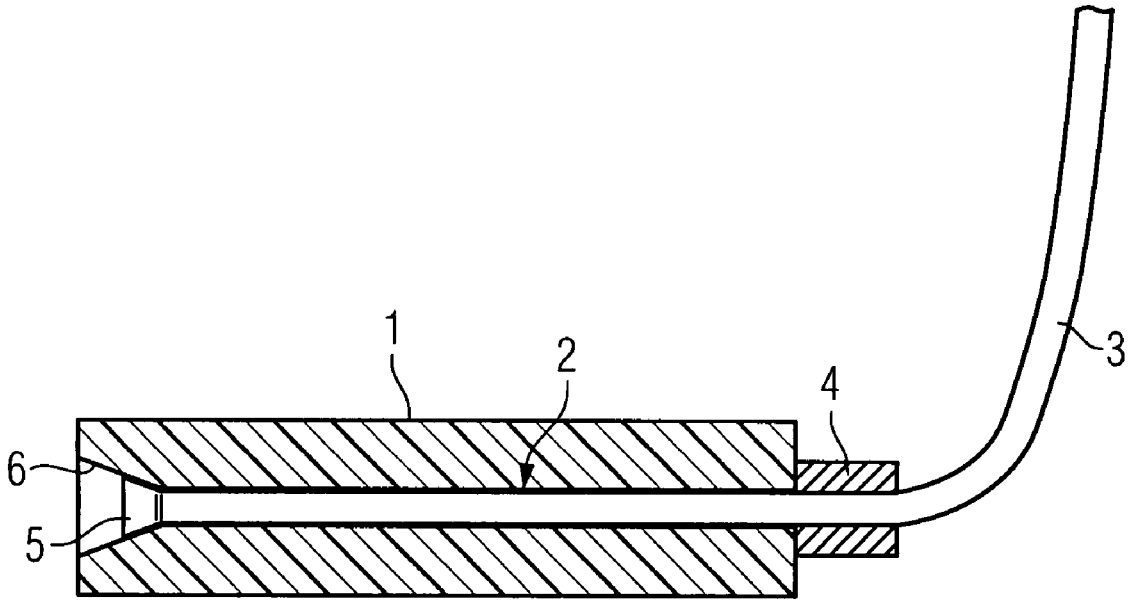
1
2
3
4
5
6

FIXING A SOUND TUBE IN A HEARING APPARATUS

CROSS REFERENCE TO RELATED APPLICATIONS

This application claims priority of German application No. 10 2006 018 156.5 filed Apr. 19, 2006, which is incorporated by reference herein in its entirety.

FIELD OF THE INVENTION

The present invention relates to a hearing apparatus having a sound tube for transmitting a sound and having a bore, into which the sound tube is inserted. Furthermore, the present invention relates to a method for fastening a sound tube in the bore.

BACKGROUND OF THE INVENTION

Hearing devices which do not require individual otoplastics have been available on the market for some time. Plastic plugs take the place of the otoplastics in this case. The acoustic characteristics of such plugs nevertheless restrict the universal applicability of these types of hearing device. To provide for more severe hearing loss, in many cases acousticians glue a conventional otoplastic or an ITE shell (in-the-ear) to the sound tube instead of the plug.

The tubes used in hearing devices are however exposed to the prevailing environmental conditions and are thus subject to an increased ageing process. Consequently, the problem consists in the tubes having to be exchanged again after some time. This is however not easily possible due to the minimal diameter and the material used for the tube. The otoplastics and ITE shells can only be reused, if at all, by counterboring the tube element glued thereto. Reuse involves cutting the new piece of tube to the corresponding length and re-gluing it into the bore of the otoplastic and/or ITE shell.

The publication DE 20 2005 004 245 U1 discloses an in-the-ear hearing device shell. A sound tube is fastened to a flange by pulling the tube over said flange. A groove in the flange is used to fix the tube.

Furthermore, the patent application DE 195 23 991 B4 describes a hearing device having a suspended earpiece and a sound tube. The suspended earpiece also features a rotating groove at the end at which the sound tube is disposed.

Finally, the publication DE 94 06 801 U1 discloses a sound tube, which is held in place by means of an integrally molded annular collar on the front shoulder of a tubular support.

SUMMARY OF THE INVENTION

The object of the present invention thus consists in devising the exchange of a sound tube in a hearing device in a simpler manner.

In accordance with the invention, this object is achieved by a hearing apparatus having a sound tube for transmitting a sound and having a bore, into which the sound tube is inserted, with the sound tube being melted at one end such that its outer diameter at said end is greater than the inner diameter of the bore.

In accordance with the invention, provision is further made for a corresponding method for fastening a sound tube in a bore of a hearing apparatus by melting one end of the sound tube so that its outer diameter increases and inserting the sound tube into the bore, the inner diameter of which is smaller than the enlarged outer diameter of the end of the sound tube, until the extended end of the sound tube rests closely against one side of the bore.

A tube assembled in accordance with the invention can thus be removed from the bore by simply cutting it off, without having to bore or counterbore the bore. In addition, the shell or the otoplastic can be rotated approximately about the tube, so that a fine tuning of the angle is possible. On account of this, this ability to rotate exists because the tube is not glued into the bore. Furthermore, the insertion of a new tube into the bore is possible in a very simple manner by means of drawing it therethrough.

With a particular embodiment, the inventive hearing apparatus comprises a hearing device shell, in which the bore is located. Alternatively, the hearing apparatus can also feature an otoplastic, in which the bore is arranged. In both instances, the tube can then be attached directly to and removed from the hearing device shell and/or otoplastic without any difficulty.

Alternatively, the inventive hearing apparatus can also comprise an adapter, in which the bore is located. This enables an adapter of any design to be fastened to the end of a sound tube in a simple manner. If the inner diameter of the bore is adequately small compared to the outer diameter of the tube, the adapter is mounted on the tube end in a rotatable fashion.

The bore is preferably fashioned at one end in the shape of a cone. This shape has several advantages. On the one hand, the tube end can be similarly fashioned as a cone, by drawing it into this shape. On the other hand, an increased seal effect can be achieved by means of the cone-shaped surface. Furthermore, the cone shape has the advantage that the overall expanded segment of the tube end can be completely accommodated in the bore.

If the end of the sound tube with the enlarged outer diameter is positioned on the one side of the bore, a sleeve fixed to the sound tube can be arranged on the other side of the bore. This sleeve serves to prevent the sound tube from being able to slide from this side into the bore. The sleeve is favorably manufactured from plastic or rubber. In the case of rubber or a rubber-like plastic, the sleeve can be fastened on the tube by means of frictional resistance. If the sleeve consists however of a harder plastic or another hard material, it can be glued to the sound tube. The disassembly of the tube can herewith be carried out in a simple manner such that the tube is cut through between the sleeve and the bore.

BRIEF DESCRIPTION OF THE DRAWINGS

The present invention is now described in more detail with reference to the appended drawing, which shows a segment through a component of a hearing apparatus, in which a sound tube is fixed in accordance with the invention.

DETAILED DESCRIPTION OF THE INVENTION

The exemplary embodiment illustrated in more detail below represents a preferred embodiment of the present invention.

An otoplastic 1 is illustrated schematically in the Fig. The symbolically represented otoplastic 1 can also be an ITE shell for an in-the-ear hearing device or an adapter, which is inserted into an otoplastic or into a hearing device shell. A bore 2 is located in the otoplastic 1. This bore 2 closely surrounds a tube 3 inserted therein. This means that the inner diameter of the bore 2 is marginally larger than the outer diameter of the tube 3.

The tube 3 is used to transmit the sound from the hearing device into the auditory canal and is of a relatively thin design for optical reasons. It typically exhibits an outer diameter of less than 2.5 mm.

The thin tube 3 is to be secured on both sides of the otoplastic 1, so that it is not able to slide out of the bore in either of the two directions. For this reason, a rubber or plastic sleeve 4 is attached to the tube in a freely moveable fashion. During the assembly, the tube is firstly cut to the right length and is then moved through the bore 2 using the free end.

By heating the free end, the plastic softens and the heated tube end adopts a spherical design and/or extends its overall diameter by virtue of the production history (e.g. stretching during extrusion) or by virtue of the surface voltage. After cooling, the extended tube end 5 can no longer be pulled through the bore 2.

A particularly advantageous embodiment of the bore 2 consists in said bore taking the form of a funnel or a cone on the end at which the tube 3 is expanded. This enables the tube with the heated, extended tube end 5 to be pulled back into the conical area 6 of the bore 2, where it is finally left to cool down. The extended end 5 of the tube 2 likewise herewith adopts the conical shape, thereby enabling an increased mechanical rigidity as well as an improved seal to be achieved between the tube and the bore. After drawing-in and fixing the tube 2 to the side with the extended tube end, the tube 3 is now also fastened to the opposite side of the bore 2 with the aid of the sleeve 4. This is carried out by moving the sleeve 4 towards the otoplastic 1 and potentially gluing it thereto, if the frictional forces between the tube 3 and the sleeve 4 are not sufficient for this. The tube 3 in the bore 2 is thus protected against movement in both directions.

The sleeve 4 is pulled away from the otoplastic 1 in order to remove the tube 3 from the bore 2, so that the extended end 5 of the tube 3 can be moved out of the bore 2 and cut off. The tube 3 is then able to be easily pulled out of the bore 2.

If the sleeve 4 is glued to the tube 3, it is possible to cut through the tube 3 between the sleeve 4 and the otoplastic 1 using a knife. The piece of tube 3 remaining in the bore can then be pushed out using a pin.

The invention claimed is:

1. A hearing apparatus, comprising:

a bore with an inner diameter;

a sound tube that is inserted into the bore for transmitting a sound; and a hearing device shell in which the bore is located, and wherein the shell is configured to rotate about the sound tube, wherein one end of the sound tube is configured to have an outer diameter that is larger than the inner diameter of the bore, wherein the one end of the sound tube is spaced within the bore by at least a distance such that the one end of the sound tube is completely accommodated within an interior of the bore, wherein the one end of the sound tube is heated in order to obtain the larger outer diameter, and wherein one end of the bore has a conical shape, wherein the one end of the sound tube has a conical shape, and wherein the conical shape of the bore is larger than the conical shape of the sound tube such that the sound tube is completely accommodated within the conical shape of the bore.

2. The hearing apparatus as claimed in claim 1, further comprising an otoplastic in which the bore is located, and wherein the otoplastic is configured to rotate about the sound tube.

3. The hearing apparatus as claimed in claim 1, further comprising an adapter in which the bore is located.

4. The hearing apparatus as claimed in claim 1, wherein the sound tube comprises a sleeve that is arranged on another side of the bore to fasten the sound tube at the another side of the bore.

5. The hearing apparatus as claimed in claim 4, wherein the sleeve comprises a plastic or a rubber.

6. The hearing apparatus as claimed in claim 4, wherein the sleeve is fastened to the sound tube by a friction fit.

7. The hearing apparatus as claimed in claim 4, wherein the sleeve is glued to the sound tube.

8. A method for fastening a sound tube in a bore of a hearing apparatus, comprising:

melting one end of the sound tube for enlarging an outer diameter of the one end of the sound tube to be greater than an inner diameter of the bore;

inserting the sound tube into the bore until the one end of the sound tube having the larger outer diameter rests against one side of the bore; and allowing the one end of the sound tube to cool within the bore such that the one end of the sound tube within the bore adopts a shape of the one side of the bore.

9. The method as claimed in claim 8, wherein the sound tube is fastened to another side of the bore by a sleeve.

* * * * *